US007855352B2

(12) United States Patent
Chen et al.

(10) Patent No.: US 7,855,352 B2
(45) Date of Patent: Dec. 21, 2010

(54) SHIELDING DOOR DEVICE FOR RADIATION INSPECTION SYSTEM

(75) Inventors: Zhiqiang Chen, Beijing (CN); Yuanjing Li, Beijing (CN); Yinong Liu, Beijing (CN); Haifeng Hu, Beijing (CN); Wanlong Wu, Beijing (CN); Yulan Li, Beijing (CN); Xilei Luo, Beijing (CN); Li Zhang, Beijing (CN); Ziran Zhao, Beijing (CN); Bin Sang, Beijing (CN); Hailin Wang, Beijing (CN)

(73) Assignees: Nuctech Company Limited, Beijing (CN); Tsinghua University, Beijing (CN)

( * ) Notice: Subject to any disclaimer, the term of this patent is extended or adjusted under 35 U.S.C. 154(b) by 1128 days.

(21) Appl. No.: 11/523,779

(22) Filed: Sep. 19, 2006

(65) Prior Publication Data

US 2007/0075073 A1 Apr. 5, 2007

(30) Foreign Application Priority Data

Sep. 22, 2005 (CN) ..... 2005 1 0086457

(51) Int. Cl.
*H05B 6/64* (2006.01)

(52) U.S. Cl. ..... 219/741; 219/756; 219/763; 126/21 A

(58) Field of Classification Search ..... 219/741, 219/392, 714, 749, 756, 678, 702, 761, 746, 219/685, 762, 723, 679; 126/21 A, 190, 126/191, 192, 194, 197, 340
See application file for complete search history.

(56) References Cited

U.S. PATENT DOCUMENTS 4,450,335 A * 5/1984 Shimizu et al. ..... 219/723
5,416,330 A * 5/1995 Abul-Faraj et al. ..... 250/395
6,166,353 A * 12/2000 Senneville et al. ..... 219/385
7,244,916 B2 * 7/2007 Iwamoto ..... 219/756

FOREIGN PATENT DOCUMENTS

DE 3236290 A * 4/1984

* cited by examiner

*Primary Examiner*—Quang T Van
(74) *Attorney, Agent, or Firm*—Westman, Champlin & Kelly, P.A.

(57) ABSTRACT

A radiation inspection system includes a shielding door device for a radiation inspection system, comprising a door body, two guides located on two opposite sides of the door body, a rack, a gear and a motor. The two guides are fixed on an upper surface of a frame and the door body is movably connected to the two guides via bearings. The rack is fixed on a bottom of the door body and meshed with the gear. The gear is coupled with a shaft of the motor fixed on a lower surface of the frame. This configuration is advantageous in automatic and complete shielding of the radiation inspection system without interference. In addition the shielding door can be controlled intelligently, so that accidental radiation leakage can be prevented.

6 Claims, 4 Drawing Sheets

SHIELDING DOOR DEVICE FOR RADIATION INSPECTION SYSTEM

The present application is claims priority of Chinese patent application Serial No. 200510086457.x, filed Sep. 22, 2005, the content of which is hereby incorporated by reference in its entirety.

BACKGROUND OF THE INVENTION

1. Field of the Invention

The present invention relates to a radiation inspection system, particularly to a shielding door device for a radiation inspection system.

2. Description of the Related Art

Conventionally, a shielding device for an inlet and outlet of a sensitive region of detection of a radiation inspection system is usually a rubber curtain with a lead layer sandwiched therebetween. However, the shielding device adversely affects convenient entry and exit of an examined object into and out of the sensitive region of detection because it is passive. The shielding device in the passive form cannot be configured in a completely closed form. Radiation leakage will thus occur so that the shielding effect is not ideal. Furthermore, the shielding device can be used only vertically due to limitation of its configuration.

SUMMARY OF THE INVENTION

The present application is made in view of the above problems of the prior art. It is an object of the present invention to provide a shielding door device for a radiation inspection system which is capable of automatically and completely shielding the radiation inspection system without interference.

In accordance with one aspect of the present invention, there is provided a shielding door device for a radiation inspection system, comprising a door body, guides for guiding the door body so that the door body moves along the guides, and a driving device adapted to drive the door body to move along the guides.

In accordance with another aspect of the present invention, there is provided a shielding door device for a radiation inspection system, comprising a door body, guides respectively located at two opposite sides of the door body, a rack, a gear and a motor. The two guides are fixed on an upper surface of a frame and the door body is movably connected to the two guides via bearings. The rack is fixed on a bottom of the door body and meshed with the gear. The gear is coupled with a shaft of the motor fixed on a lower surface of the frame.

In accordance with one aspect of the present invention, a proximity switch for closing the door body and a proximity switch for opening the door body are disposed on the lower surface of the frame at a front end and a rear end thereof so as to limit the opening and closing positions of the door body.

In accordance with one aspect of the present invention, rubber stoppers for stopping the door body are disposed respectively on the upper surface of the frame at the front end and the rear end thereof.

In accordance with one aspect of the present invention, the door body is made of a metal material having a radiation protection function or general metal materials incorporating an additional metal material shielding layer having a radiation protection function.

In accordance with one aspect of the present invention, the metal material shielding layer is made of a lead alloy.

With the above configurations, the shielding door device provides the following technical effects.

In accordance with still another aspect of the present invention, there is provided a shielding door device for a radiation inspection system, comprising a door body, guides, and motor. The guides are fixed on an upper surface of a frame and disposed with position limiting sliding member for defining a movement trajectory or locus of the door body; the door body is connected to a shaft of the motor by a key and a set screw, and movably connected to the guide via a rolling ball. The door body is rotated on or pivots around the shaft of the motor within a scope defined by the guide so as to close and open the shielding door.

In accordance with one aspect of the present invention, a proximity switch for closing the door body and a proximity switch for opening the door body are disposed on a lower surface of the frame at front and rear ends between which the door body are rotated, so as to limit the opening and closing positions of the door body.

In accordance with one aspect of the present invention, rubber stoppers for stopping the door body are disposed on the upper surface of the frame at the front and rear ends between which the door body is rotated.

1. Since a single integral shielding door is used, a completely closed shielding can be achieved.

2. Since the shielding door can be electrically controlled intelligently, the shielding device has no adverse effect on entry and exit of an object into and out of a sensitive region of detention of the radiation inspection system.

3. Since position limiting devices for the door body is adopted, it can be ensured that the radiation inspection system will not start detection operation before the shielding door has been closed, so that accidental radiation leakage can be prevented.

DETAILED DESCRIPTION OF THE EMBODIMENTS

The embodiments of the present invention will be further described below in conjunction with the accompanying drawings.

Figure 1:
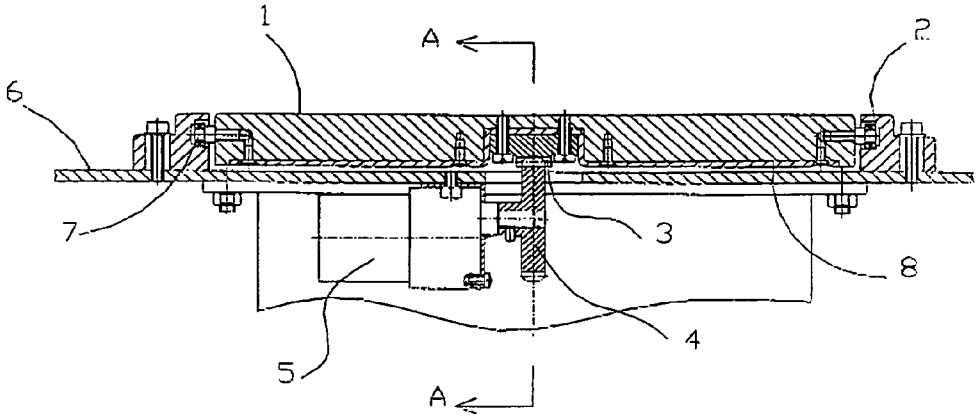
FIG. 1 is a schematic view showing configuration of a shielding door device according to an embodiment of the present application.
Figure 2:
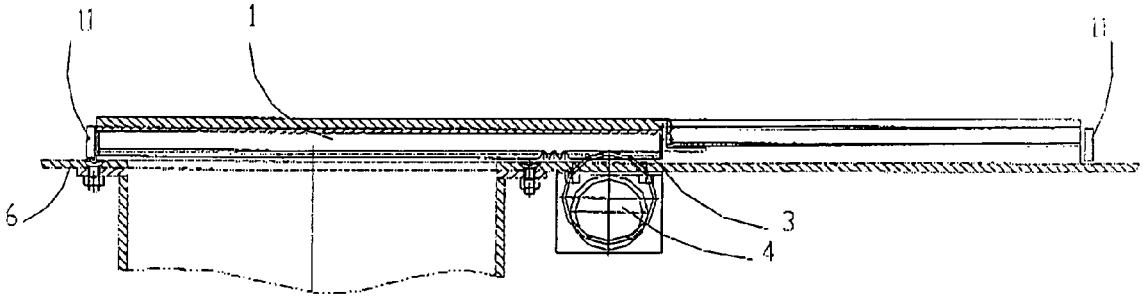
FIG. 2 is a sectional view taken along line A-A of FIG. 1.
Figure 3:
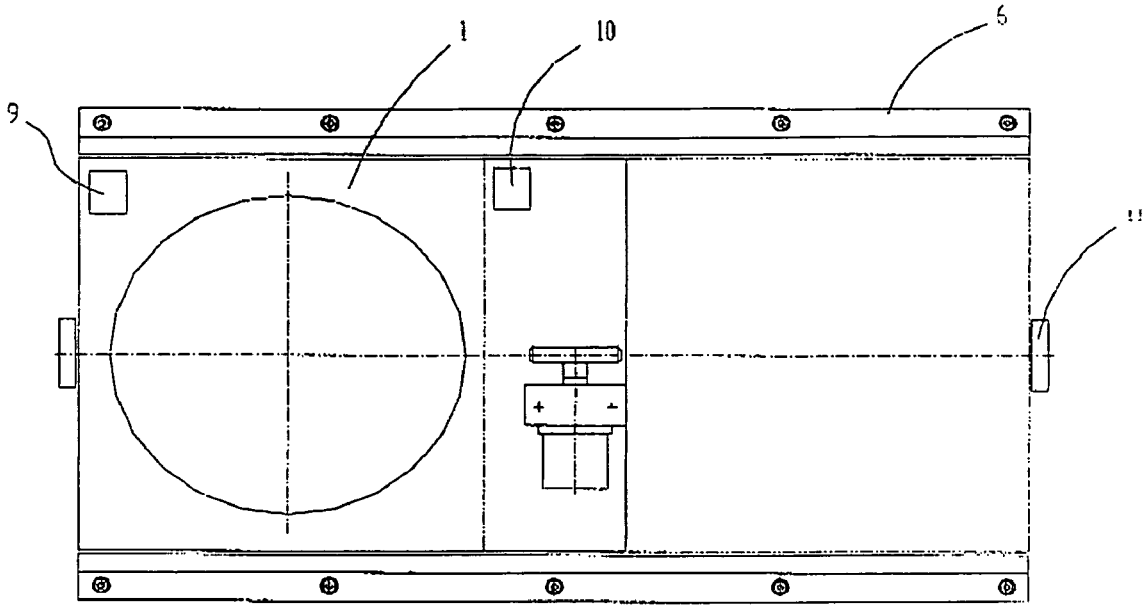
FIG. 3 is a schematic view of the shielding door device viewed from the above side of FIG. 2.

Referring to FIG. 1 to FIG. 3, a shielding door device according to a first embodiment of the present application comprises a door body 1, guides 2 (for example, two guides 2) respectively located on two opposite sides of the door body 2, a rack 3, a gear 4 and a motor 5. The door body 1 is made of a metal material having radiation protection function or general metal materials incorporating an additional metal material shielding layer 8 having radiation protection function. The metal material shielding layer 8 may be made of a lead alloy. The two guides 2 are fixed on an upper surface of a frame 6 and the door body 1 is movably connected to the two guides 2 via bearings 7. The rack 3 is fixed on a bottom of the door body 1 and meshed with the gear 4. The gear 4 is coupled with a shaft of the motor 5 fixed on a lower surface of the frame 6. A proximity switch 9 for closing the door body 1 and a proximity switch 10 for opening the door body 1 are disposed on the lower surface of the frame 6 at a front end and a rear end thereof for limiting the opening and closing positions of the door body 1. Rubber stoppers 11 for stopping the door body 1 are disposed on the upper surface of the frame 6 at the front end and the rear end thereof.

The guides 2 may comprise, for example, two runners, two tracks, or two guide rails)

In alternative embodiments, a screw and a nut may be used in place of the rack and the gear of the driving device.

When the shielding door device is used, the door body 1 is installed at a shielding position with the frame 6. The motor 5 drives the door body 1 so as to open and close it. Position limiting switches (not shown) integrated with the rubber stoppers 11, the proximity switch 9 for closing the door body 1 and the proximity switch 10 for opening the door body 1 transmit signals to a control system (not shown) so as to electrically control the door body 1 in an intelligent manner. As a result, accidental radiation leakage can be prevented.

Figure 4:
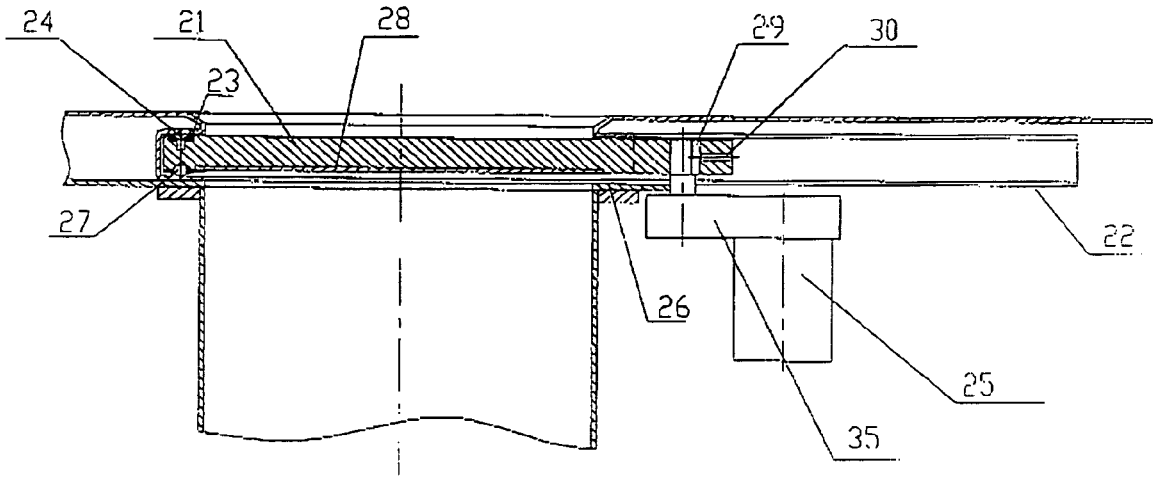
FIG. 4 is a schematic view showing configuration of a shielding door device according to another embodiment of the present application.
Figure 5:
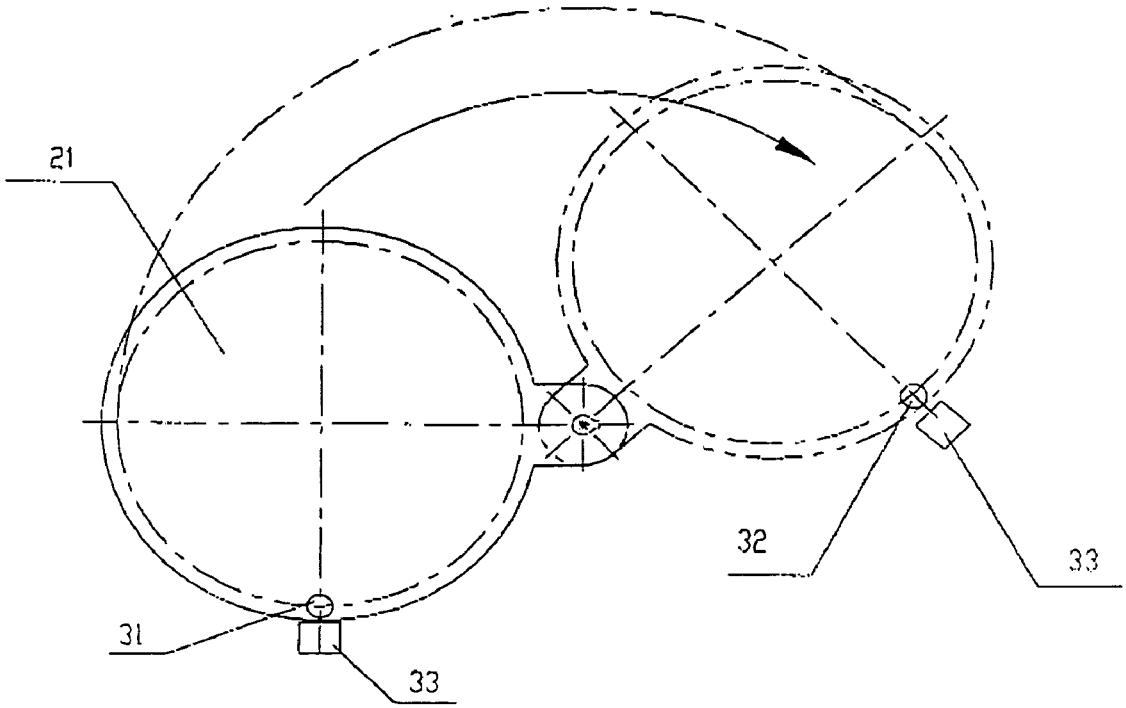
FIG. 5 is a schematic view showing operation of the shielding door device shown in FIG. 4.

Referring to FIG. 4 to FIG. 5, a shielding door device according to the second embodiment of the present application will be explained. The shielding door device comprises a door body 21, a guide 22, and a motor 25. The door body 21 is made of a metal material having a radiation protection function or general metal materials incorporating an additional metal material shielding layer 28 having the radiation protection function. The metal material shielding layer 28 may be made of a lead alloy. The guides 22 are fixed on an upper surface of a frame 6 and the door body 21 is movably connected to the guide 22 via a ball 27. The ball 27 is connected to the door body 21 in such a manner that the ball 27 is capable of rolling. A position limiting sliding groove 23 is disposed in an upper surface of the door body 21 at an edge of the door body 21 diametrically opposite to a shaft of the door body (which will be described latter). A position limiting sliding member 24 fixed to the guide 22 is movably fitted in the position limiting groove 23. The door body 21 is connected to an output shaft of a speed reducer 35 by a key 29 and a set screw 30.

A proximity switch 31 for closing the door body and a proximity switch 32 for opening the door body are disposed on a lower surface of the frame 26 at front and rear ends between which the door body 21 are rotated, so as to limit the opening and closing positions of the door body 21. Rubber stoppers 33 for stopping the door body 21 are disposed on the upper surface of the frame 26 at the front and rear ends between which the door body 21 are rotated.

The position limiting sliding member 24 on the guide 22 may comprises one position limiting sliding member, or a plurality of position limiting sliding members.

When the shielding door device is used, the door body 21 is driven by the motor 25 through the speed reducer 35 so as to be rotated on or pivot around the shaft of the door body 21. The ball 27 is used to reduce a resistance generated during rotation of the door body 21. The position limiting sliding member 24 is movably fitted in the position limiting groove 23 so as to guide a trajectory or locus of movement of the door body 21. Position limiting switches (not shown) integrated with the rubber stoppers 33, the proximity switch 31 for closing the door body and the proximity switch 32 for opening the door body transmit signals to a control system (not shown) so as to electrically control the door body 21 in an intelligent manner. As a result, accidental radiation leakage can be prevented.

In some embodiments, a slider, a roller, a bearing or the like can be used instead of the ball 27.

In some embodiment, a ball, a roller, a slider, or the like can be adopted in place of the position limiting sliding member 24 and the position limiting groove 23, and directly move on the guide. The shaft of the door body is coupled to the output shaft of the speed reducer through a coupling, and rotatably mounted to the frame. In this case, the door body can rotate merely on or around the shaft of the door body. Therefore, the position limiting sliding member 24 and the position limiting groove 23 are not necessary.

In some embodiment, the guide 22 may be disposed substantially along the movement trajectory of the edge of the door body diametrically opposite to the shaft of the door body. The movement trajectory is generated by said edge diametrically opposite to the shaft of the door body when the door body rotates on or around the shaft of the door body. The guide 22 may comprises a guide groove, while a slider, a bearing, a roller, or the like for engaging with the guide groove may be disposed on said edge diametrically opposite to the shaft of the door body. The door body is rotatably mounted at the frame through the shaft of the door body.

Although the door body is disposed substantially in a horizontal plane in the above embodiment, the present application is not limited to the embodiment. For example, the door body 1 may be arranged substantially vertically or aslant with respect to the horizontal plane. Therefore, the above terms associated with orientations of the elements, such as "upper surface", "lower surface", and "bottom", are merely illustrative, and the present application is not limited to the terms. When the door body 1 is disposed in different orientations, for example, the above terms apparently may vary accordingly. For example, the terms "upper surface" and "lower surface" may become "left surface" and "right surface" or "first surface" and "second surface".

The invention claimed is:

1. A shielding door device for a radiation inspection system, comprising:

a door body rotatably connected to a frame through a shaft;

a guide for guiding the door body so that the door body moves along the guide;

a driving device adapted to drive the door body to rotate around the shaft, and a ball disposed to the door body in such a manner that the ball is capable of rolling, wherein the door body is in contact with and moves along the guide via the ball.

2. The shielding door device according to claim 1, wherein the driving device comprises a speed reducer with an output shaft connected to the shaft; and a motor with an output shaft connected to the speed reducer.

3. The shielding door device according to claim 1, wherein said guide comprises two guides respectively provided on two opposite sides of the door body in a movement direction of the door body.

4. The shielding door device according to claim 1, wherein the guide is disposed substantially along a movement locus of an edge of the door body, the edge of the door body being diametrically opposite to the shaft, the movement locus being generated by said edge when the door body rotates on the shaft of the door body.

5. The shielding door device according to claim 1, wherein the door body is moved on the guide through a ball, and the ball is connected to the door body in such a manner that the ball is capable of rolling.

6. The shielding door device according to claim 1, further comprising:

a position limiting sliding groove disposed in a first surface of the door body at an edge of the door body diametrically opposite to the shaft; and a position limiting sliding member fixed to the guide and movably fitted with the position limiting groove.

* * * * *